US007075415B2

(12) United States Patent
Levin et al.

(10) Patent No.: US 7,075,415 B2
(45) Date of Patent: Jul. 11, 2006

(54) CONVERSION OF LIGHT SIGNALS TO AUDIO

(75) Inventors: Burton L. Levin, Lake Oswego, OR (US); Charles E. Pierson, Battle Ground, WA (US)

(73) Assignee: Sharp Laboratories of America, Inc., Camas, VA (US)

( * ) Notice: Subject to any disclaimer, the term of this patent is extended or adjusted under 35 U.S.C. 154(b) by 0 days.

(21) Appl. No.: 10/676,278

(22) Filed: Sep. 30, 2003

(65) Prior Publication Data

US 2005/0068188 A1 Mar. 31, 2005

(51) Int. Cl.
*G08B 3/00* (2006.01)

(52) U.S. Cl. ..... 340/384.1; 340/384.5; 340/384.71; 340/7.57; 343/116

(58) Field of Classification Search ..... 340/384.1, 340/384.5, 384.71, 815.54, 815.4, 7.57; 434/116, 434/112, 113

See application file for complete search history.

(56) References Cited

U.S. PATENT DOCUMENTS

| | | | | |
|---|---|---|---|---|
| 3,665,111 | A * | 5/1972 | Schieser | 379/32.01 |
| 4,080,517 | A * | 3/1978 | Moricca et al. | 379/52 |
| 5,345,557 | A * | 9/1994 | Wendt | 710/100 |
| 6,052,663 | A | 4/2000 | Kurzweil et al. | |
| 6,076,060 | A | 6/2000 | Lin et al. | |
| 6,097,375 | A * | 8/2000 | Byford | 345/169 |
| 6,377,928 | B1 | 4/2002 | Saxena et al. | |
| 6,408,072 | B1 | 6/2002 | Fernandez-Martinez | |
| 6,476,376 | B1 | 11/2002 | Biegelsen et al. | |
| 6,622,276 | B1 * | 9/2003 | Nagasaki et al. | 714/752 |
| 6,775,381 | B1 * | 8/2004 | Nelson et al. | 380/54 |
| 2003/0091174 | A1 * | 5/2003 | Fulford et al. | 379/167.11 |

* cited by examiner

*Primary Examiner*—Tai T. Nguyen
(74) *Attorney, Agent, or Firm*—Chernoff, Vilhauer, McClung & Stenzel

(57) ABSTRACT

A system for the automated conversion of light signals to audio.

45 Claims, 5 Drawing Sheets

CONVERSION OF LIGHT SIGNALS TO AUDIO

BACKGROUND OF THE INVENTION

The present invention relates to a system for the automated conversion of light signals that represent events or messages into audio that describes or indicates an occurrence of those events or messages.

A vast assortment of devices use light to alert people to the occurrence of an event or to display a message. For example, computers have a light that indicates whether the hard drive is active, telephones may use lights to indicate which line is active, telephones may use a LCD display to indicate the time spent on a call, telephones may display the telephone number or other information about the person on the other end of the line. Other electronic devices use lights, including LCD or LED panels to display a variety of error messages, and computer monitors display text among other graphics.

Such devices are, by design, intended to be used by the sighted population and are difficult, if not impossible for the visually impaired to use as intended. Some of those devices may be individually modified to alert a visually impaired person to the occurrence of an event by an audio message. Unfortunately, such devices are typically expensive and designing devices usable by a limited number of the visually impaired is prohibitively expensive.

What is desired, therefore, is a system for automatically converting light signals that indicate an event or message into an audio signal so that a visually impaired person may be better able to recognize the occurrence of the event or to receive the message.

DETAILED DESCRIPTION OF THE PREFERRED EMBODIMENT

Figure 1:
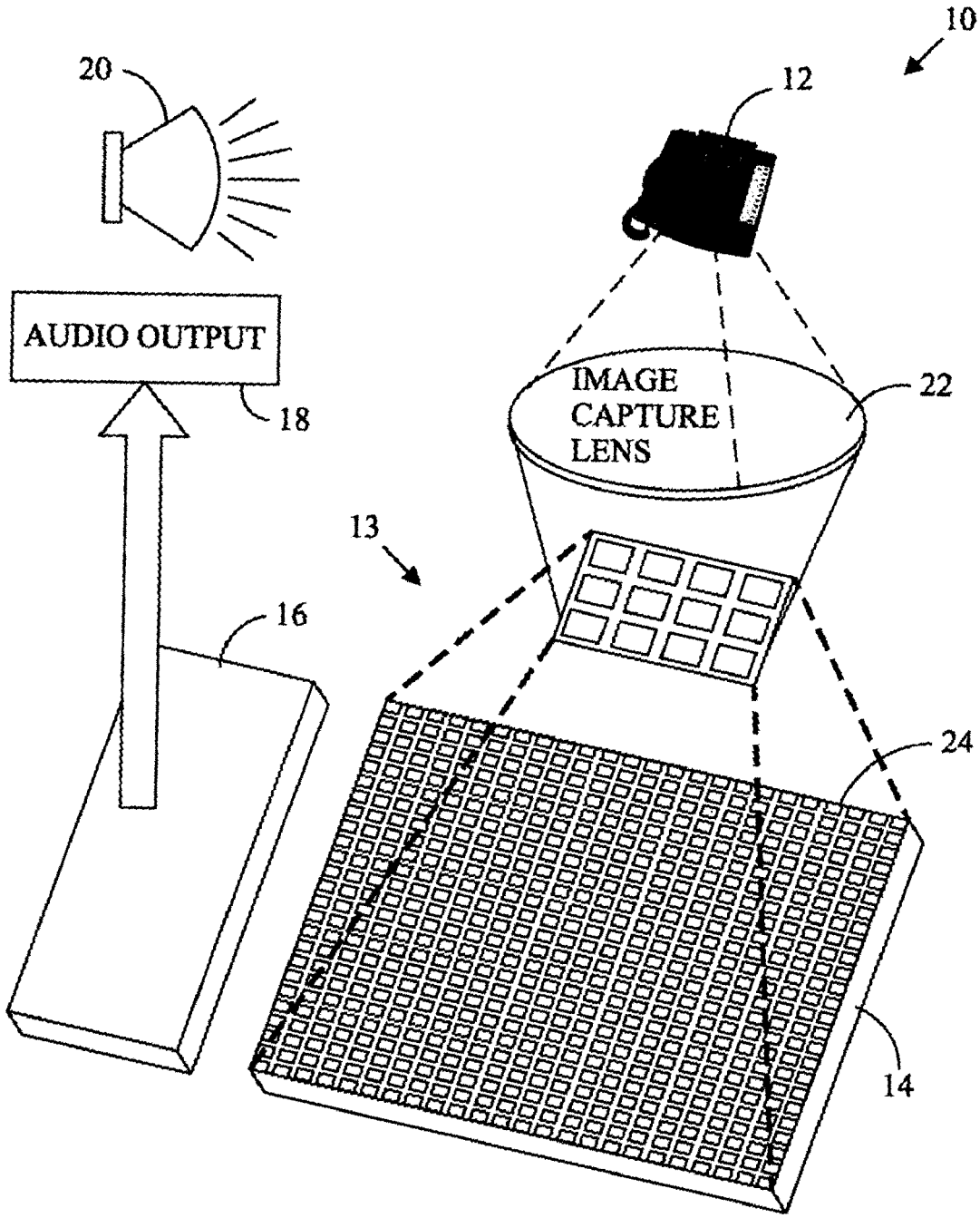
FIG. 1 is a schematic of an improved system for converting light to audio.

FIG. 1 shows an exemplary system 10 for converting light signals from a device, such as the telephone 12, to an audio output 18 from an audio device 20. The system 10 includes a receptor member 13 that may be selectively positioned above the light-emitting display of a device, such as the telephone 12, so that the light emitted by the device is received by the receptor member 13. Although a telephone 12 is depicted as the device having a light-emitting display in FIG. 1, many other devices may be used in combination with the system 10, such as a computer, a computer display, a computer hard drive, a fax machine, a printer, a modem, a PDA, and a network router among many other such devices. Preferably, the receptor member may be detachably connected to the device 12. The light emitted by the device, and hence received by the receptor member 13, preferably signifies the occurrence of an event or a message to which a user may wish to be alerted.

In the exemplary system 10, the receptor member 13 may comprise a lens 22 and an array 14 of individual light receiving members 24 that each convert light incident on the respective members 24 to respective electrical signals. The light receiving members may be charge coupled devices (CCDs), or CMOS devices, or any other device capable of converting a light signal to an electrical signal. The system 10 preferably includes a self-contained power source.

The system 10 includes a microprocessor 16 (or any processing device) operatively connected to the receptor member 13 and to the audio device 20 so as to receive the electrical signals produced by the receptor member 13, and based on those electrical signals, instruct the audio device to emit an audible message that provides information to the user as to the current activity of the device 12. The audio device 20 may optionally include a headset detachably connectable to the audio device so that only the user or users hear the audio signals from the audio device 20.

In operation, when the receptor member 13 is positioned to receive light emitted by the device 12, the device 12 will periodically emit a light signal in a manner intended to indicate to a person a message or the occurrence of an event, such as the line of an incoming telephone call, the phone number or identity of the caller, the status of a caller (i.e. whether the caller is on hold), whether the phone is on standby, etc. If the device 12 is something other than a telephone, the emitted light could refer to any one of an enormous number of occurrences such as the status of a computer hard drive, or could display text such as a news or stock ticker on a PDA. Visually impaired persons, however, may not be able to identify the emitted light, and hence may not become aware of the information intended to be conveyed by the device 12. Therefore, the receptor member 13 will receive the light signal emitted by the device and convert the light signal into an electrical signal that can be interpreted by the microprocessor 16 as signifying the message or the occurrence of the event associated with the light signal. The microprocessor 16 will then cause the audio device 20 to emit an audio signal that indicates the occurrence of the event associated with the light signal. The audio output 18 could be something simple, like a tone to indicate that a caller is on hold, or could be a vocal message stating that the caller is on hold. The audio output 18 may periodically repeat itself for the duration that the light signal associated with the event is active.

Figure 2:
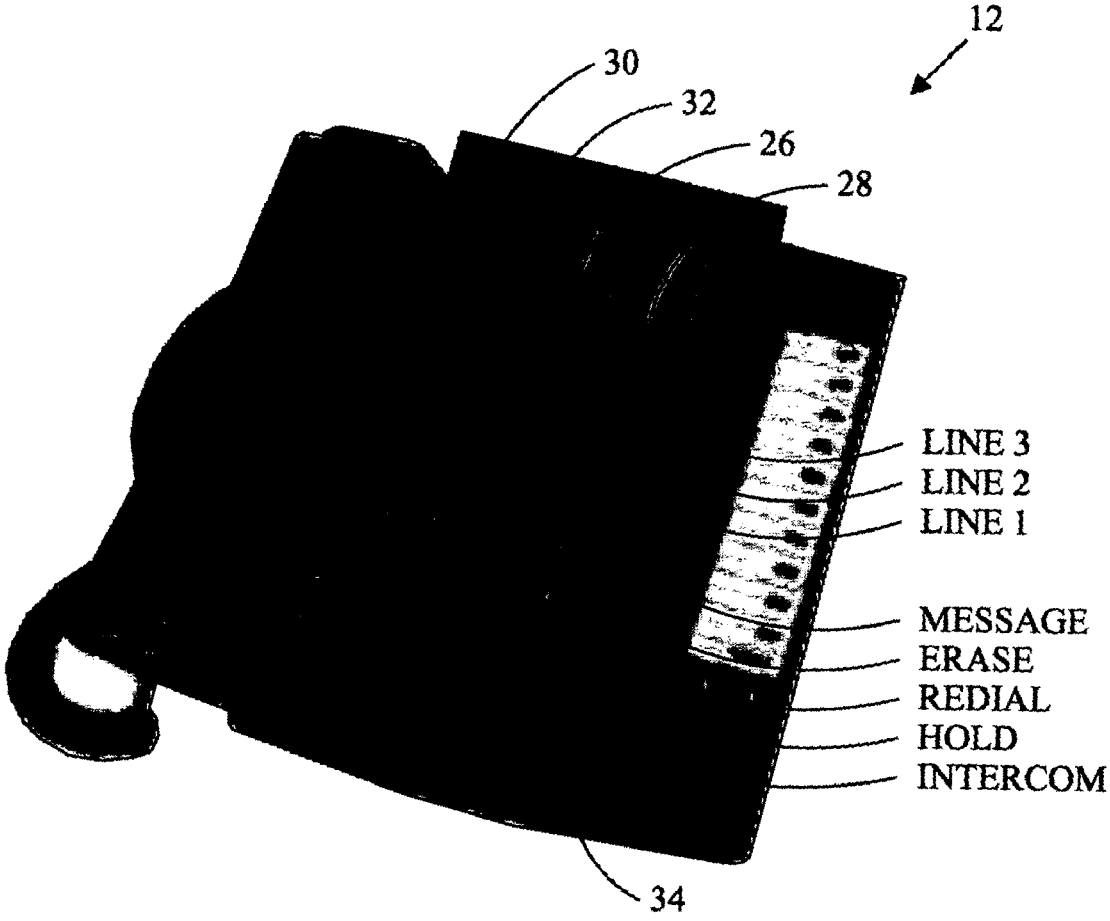
FIG. 2 is an enlarged view of the telephone shown in FIG. 1.

The system 10 permits a visually impaired person to easily receive information previously unavailable. Further, the system 10 is easily adaptable to be used in combination with a wide variety of light-emitting devices, such as a computer, a computer display, a fax machine, a printer, a modem, a PDA, or a network router as a few examples. Because of this versatility, the time and expense of adapting individual such members to be readily usable by the visually impaired may be greatly reduced Many devices, such as the telephone 12, may emit a plurality of light signals either in sequence or concurrently, each signal or combination of signals indicating a separate event or message. Referring to FIG. 2, which is an enlarged view of the telephone 12, the telephone 12 may simultaneously indicate the identity of the caller 26, the telephone number 28 of the caller, the phone line 30 the caller is using, the date and time 32, as well as whether or not a hold function 34 is active, all by emitting light signals at various positions and in specific patterns.

Figure 3:
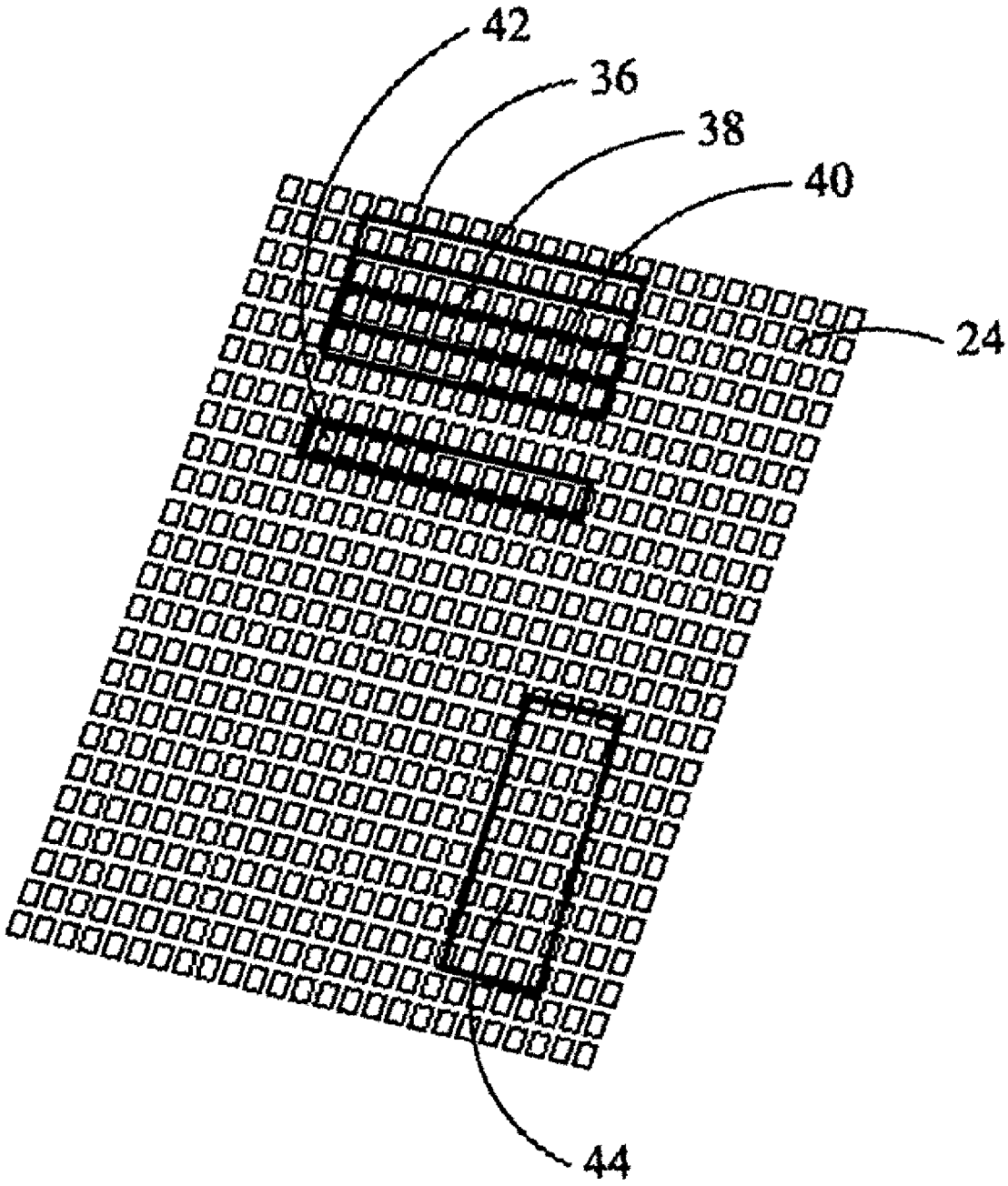
FIG. 3 is an enlarged view of the array shown in FIG. 1 having several areas of the array identified by the processor of FIG. 1 for individual processing.

The system 10 is capable of processing this simultaneous information in a manner that preserves the information provided by the light signals emitted from the telephone 12. The system 10 may include a plurality of light receiving members 24 arranged in a one or two-dimensional array 14 that may be selectively positioned over the telephone 12 or other device in a manner that holds the array 14 in a fixed relative position with respect to the device 12. This fixed position may be achieved by means of a stand, or by the use of attachment members such as Velcro, clips, or any other suitable device that detachably connects the receptor member 13 to the device 12. In this configuration, each light signal emitted by the device 12 produces a corresponding electrical signal uniquely identified by the position on the array 14. Referring also to FIG. 3, which is an enlarged view of an array 14 having areas 36, 38, 40, 42, and 44 of light receiving members 24 identified by the microprocessor 16 for individual processing. More specifically, the processor 16 may be selectively programmed for interpreting light emitted from the specific device 12 so as to identify area 36 as indicating the date and time, area 38 as indicating the identity of the caller, area 40 as indicating the phone number of the caller, area 42 as indicating the lines occupied by callers, and area 44 as indicating other information such as the status of a hold function.

The audio device 20, in turn, may be programmed with separate messages for the types of light signals detected by the microprocessor 16 in each of the aforementioned areas. For example, when a light is emitted by any or all of the respective line indicators 30, the microprocessor 16 may cause the audio device to recite the message(s) "line 1 active", "line 2 active", etc. as appropriate. If the hold function 24 is lit, the microprocessor may instruct the audio device to recite an appropriate message for that event as well.

The system 10 is capable of further enhancements. As shown in FIG. 2, many devices such as the phone 12 will display light in certain patterns that correspond to the type of information being conveyed. For example, whether or not an event, such as whether a phone line is active may simply be signaled by a lighted area. Other information, such as whether a given active line is or is not on hold may be represented by blinking or solid lights, respectively. Still other information, such as the identity or phone number of a caller may be represented in the form of text displayed on an LCD or LED panel. For that reason, the system 10 is capable of distinguishing text, solid lights, blinking lights, or other time varying and non-time varying one and two dimensional patterns of light. In addition, optical character recognition may be performed on the text together with an audio output.

To accomplish these enhancements, the microprocessor is capable of identifying certain regions of the array 14, such as 36, 38, 40, 42, and 44 as corresponding to an appropriate field, such as a text field or a light field. The microprocessor 16 may also be programmed with text to audio capability. Further, the microprocessor 16 may preferably be capable of independently sampling the electrical signal emitted by any of the light receiving members 24 to determine not only whether a light or group of lights is blinking, but the rate at which they may be blinking. In this manner, the microprocessor will be able to receive and interpret virtually any light signal emitted by a device 12 having an optical display within the two dimensional boundaries of the array 14. Because the system 10 is intended to be used in combination with the widest assortment of devices 12, the array 14 may be of any appropriate size so as to correspond to the size of the device or devices that it is intended to receive light signals from.

The microprocessor 16 may also be capable of prioritizing any separate signals being simultaneously emitted by the device 12. For example, with respect to FIG. 2, the microprocessor 16 may prioritize the signals being simultaneously received to recite an audible message in any desired sequence, e.g. "Monday, Jan. 1, 2004, 12:00; Your Mother; line 1; on hold." The microprocessor may be programmed to cause the audio device 20 to repeat this information periodically and/or may be programmed to merely cause the audio device 20 to recite and repeat information having a certain level of priority. Thus, also with respect to FIG. 2, the audio device 20 may merely repeat the information "your mother; on hold, line 1" or "line one on hold", omitting the remaining information. Further, the microprocessor may be instructed to give certain fields priority so that information from a plurality of fields is processed in a given sequence.

Figure 4:
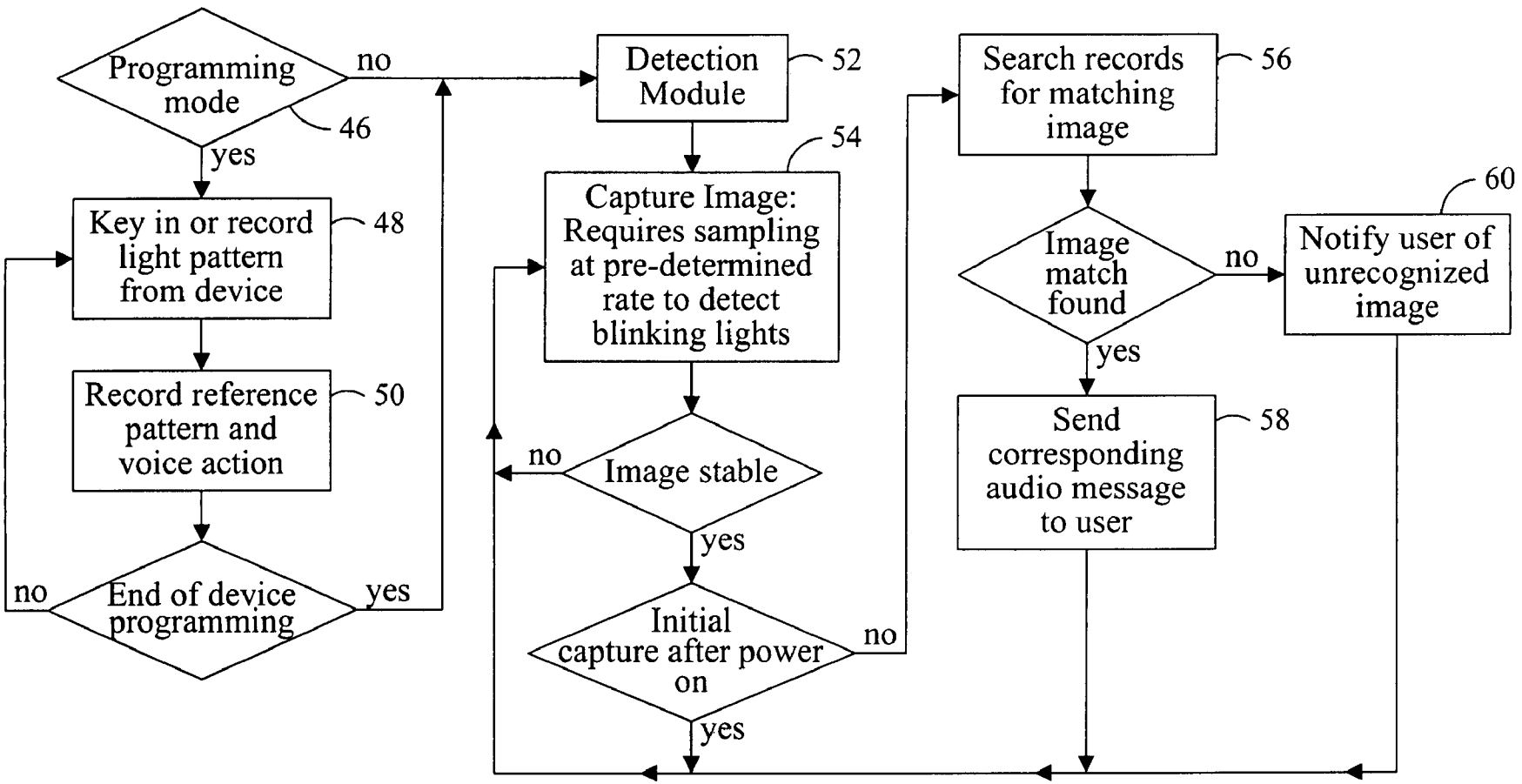
FIG. 4 is a schematic illustrating the manner in which the system of FIG. 1 may be individually programmed and may operate after being programmed.

Preferably, the system 10 is programmable so that a user may cause the system 10 to recognize certain light signals or patterns of light signals and play an audio recording specific to each programmed light signal or pattern of light signals. As previously mentioned, the processor 16 together with the array 14 is capable of individually distinguishing any one or two-dimensional, time varying or non-time varying pattern of light over a time interval so long as the array 14 is sized to cover the light-emitting display of the appropriate device 12. A system 10 may then be programmed in the manner depicted in FIG. 4.

The system 10 may include a programming mode activator associated with a programming mode 46 such that activation of the programming mode activator alternately places the system 12 into or out of the programming mode 46. The programming mode activator may comprise a button, a switch, a lever, or any other appropriate member. Alternatively, the system 10 may include first and second programming mode activators that place the system 12 into and out of the programming mode 46, respectively.

Once the programming mode 46 is activated, the user then forces 48 the light emitting device 12 to display a light pattern to be recognized by the microprocessor 16. The light pattern may be time varying, in which case the system 10 may optionally have a button, switch, or other such member that maybe activated while the time varying light pattern is being programmed into the microprocessor 16. Once the pattern is programmed, the user may optionally record 50 a voice message to be associated with the programmed light pattern or select from prerecorded voice messages or tones. Alternatively, some programming methods may have a user first record the message and then force the pattern to be associated with the message into the system 10, or, if the pattern to be recognized is either not time varying or varying in a periodic manner, the message may be recorded while the light pattern is being received by the system 10. Once the light pattern and the message have been programmed, the user may proceed to program more combinations of light patterns and messages or may exit the programming mode.

Once programmed, either by the user or by a manufacturer, the system 10 may be used in combination with an appropriate device 12. Once the system 10 is powered up and placed into a detection mode 52, the system will capture any patterns of light emitted onto the array 14 by the device 12 by sampling 54 the electrical signals from the light receiving members 24 until the image is stable, where the term "stable" is meant to include a periodically repeating pattern of lights. If this is the first stable pattern captured after the device 12 or system 10 is powered on, the system 10 will continue sampling the electrical signals until one of a subsequent pattern has stabilized. Once a subsequent pattern has stabilized, the system 10 will search 56 for a matching pattern in its program and any associated audio file. If a matching pattern is found, along with an associated audio file, that audio file may be played 58 by the audio device. If no matching pattern is found, or if one is found, but there is no associated audio file, the system may either play a default recording or tone 60, or may ignore the pattern. As mentioned previously, the system 10 is capable of processing separate areas of the array 14 to detect simultaneous light patterns and prioritize the resulting audio messages as desired.

Figure 5:
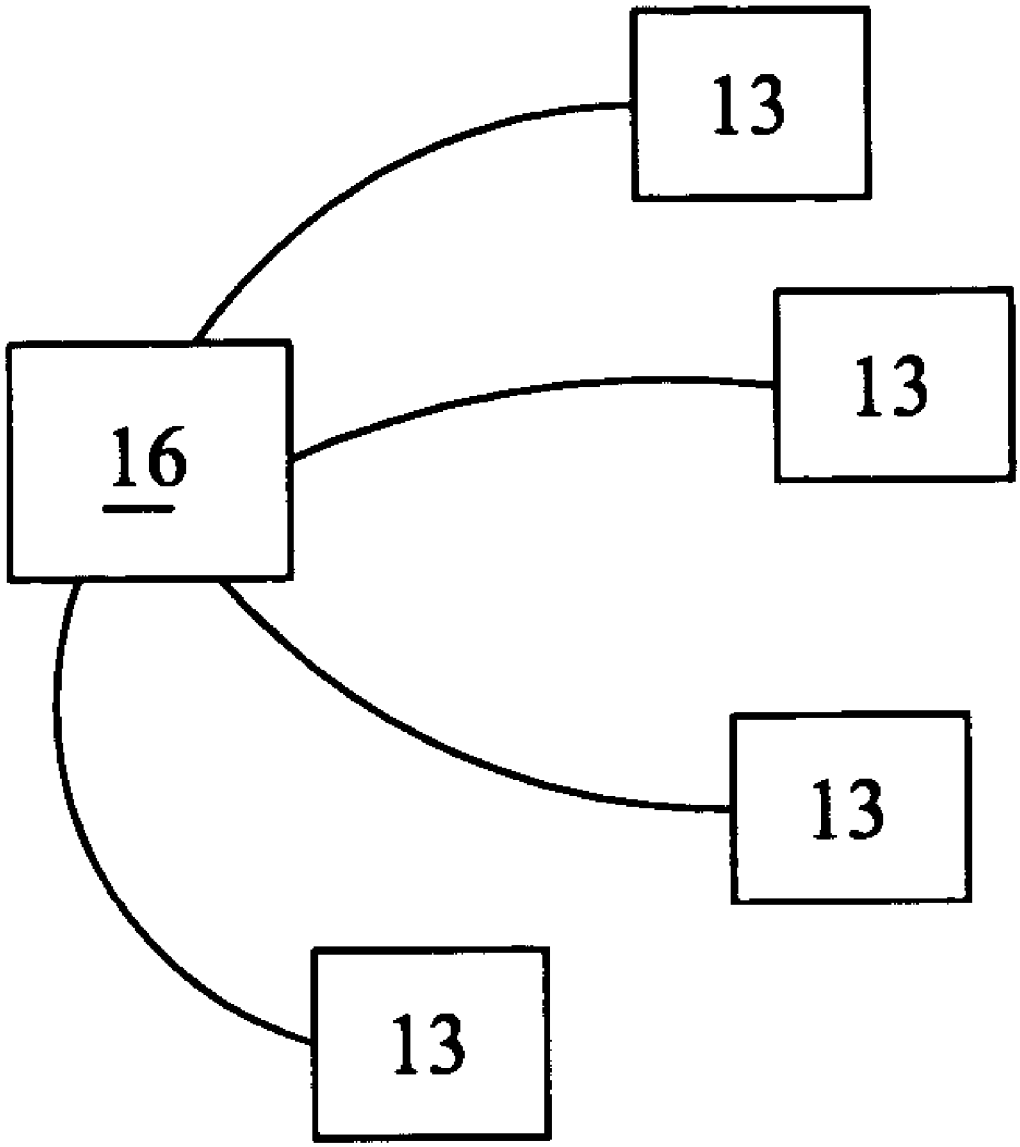
FIG. 5 is a figure of network of systems shown in FIG. 1.

Referring to FIG. 5, multiple units 62 of the receptor member 13 may be connected to respective devices and linked to a common microprocessor. Thus a visually impaired person could be conveniently alerted to messages or events indicated by light signals from a variety of types of devices 12 throughout an office or a residence without having to disassemble a system 10 from one such device 12 and reconnect the system 10 to another device. Moreover, the microprocessor 16 in such a networked system could be programmed to identify the particular device from which a signal is being received and prioritize the importance of that signal in the event that multiple devices 12 are simultaneously transmitting light signals. The individual receptor members 13 may communicate to the microprocessor through any available means, such as a coaxial cable or a wireless transmission.

The terms and expressions that have been employed in the foregoing specification are used therein as terms of description and not of limitation, and there is no intention, in the use of such terms and expressions, of excluding equivalents of the features shown and described or portions thereof, it being recognized that the scope of the invention is defined and limited only the claims that follow.

The invention claimed is:

1. A system comprising:

(a) a receptor member having one or more light-receiving members, each light receiving member capable of generating a respective electrical signal in response to light incident on said light-receiving member, said receptor member detachably connectable to a light-emitting member that indicates the existence of an event by emitting a light signal associated with said event;

(b) a processor operatively connected to said receptor member so as to receive said respective electrical signals from said receptor member, said processor being user-programmable to associate said event with said light signal, said processor operatively connected to an audio member capable of emitting an audio signal associated with said event; and (c) said user-programmable processor being capable of causing said audio member to emit said audio signal when said receptor member is connected to said light emitting member and said light emitting member emits said light signal.

2. The system of claim 1 where said receptor member is detachably connectable to a light emitting member capable of indicating the existence of one of a plurality of events by emitting one of a plurality of light signals, each respective light signal uniquely associated with one of said plurality of events, said audio member is capable of generating a plurality of audio signals, each said audio signal associated with one of said plurality of events, and said processor is capable of causing said audio member to emit the audio signal associated with a one of said plurality of events when said receptor member is connected to said light emitting member and said light emitting member emits the light signal associated with said one of said plurality of events.

3. The system of claim 2 where at least two of said plurality of events are not mutually exclusive and said processor is capable of causing said audio member to emit the audio signals associated with said at least two of said plurality of events when said light emitting member simultaneously emits the light signals associated with said at least two of said plurality of events.

4. The system of claim 3 where said processor prioritizes said at least two of said plurality of events into a sequence and causes said audio member to emit the audio signals associated with said at least two of said plurality of events in said sequence.

5. The system of claim 2 where at least two of said plurality of events are not mutually exclusive, and said processor prioritizes said at least two of said plurality of events so that said processor causes said audio member to emit the audio signal associated with only one of said at least two of said plurality of events when said light emitting member simultaneously emits the light signals associated with said at least two of said plurality of events.

6. The system of claim 1 where at least one of said events is associated with a time varying light signal.

7. The system of claim 6 where said processor is capable of sampling the respective electrical signals received from said receptor member to detect said at least one of said events.

8. The system of claim 1 having a self-contained power source.

9. The system of claim 1 where said receptor member comprises a plurality of charge coupled devices.

10. The system of claim 1 where said receptor member comprises a plurality of CMOS devices.

11. The system of claim 1 where said receptor member is detachably connectable to at least one of a computer, a computer display, a telephone display, a fax machine display, computer printer display, a modem, a PDA, or a network router.

12. The system of claim 1 where said processor is programmable by sampling the respective electrical signals received from said receptor member to detect said at least one of said events.

13. The system of claim 12 where said audio device is programmable.

14. The system of claim 1 including a plurality of said receptor members, each detachably connectable to one of a plurality of said light emitting members and said processor is capable of causing said audio device to emit an audio signal associated with an event associated with a light signal from any of said plurality of said light emitting devices.

15. The system of claim 1 including a headset detachably connectable to said audio device.

16. The system of claim 1 where said audio signal is a voice recording.

17. The system of claim 1 where said processor prioritizes electrical signals from said light sensitive devices into a sequence and processes the electrical signals in said sequence.

18. The system of claim 1 where said processor is capable of recognizing at least one two dimensional pattern of light emitted by said light-emitting member and associating an event with each said at least one pattern.

19. The system of claim 18 where said audio device has a default audio signal associated with undefined patterns of light and said processor causes said audio device to emit said default audio signal when said light emitting device emits an undefined pattern of light.

20. The system of claim 1 where said light-emitting device displays words, said processor is capable of distinguishing said words and causing said audio device to audibly recite said words.

21. A system comprising:

(a) plural receptor members, each having one or more light-receiving members, each light receiving member capable of generating a respective electrical signal in response to light incident on said light-receiving member, each said receptor member detachably connectable, independently of other said plural receptor members, to a light-emitting member that indicates the existence of an event by emitting a light signal associated with said event; and (b) a processor selectively, operatively connectable to more than one said receptor member so as to simultaneously receive said respective electrical signals from connected said receptor members, said processor operatively connected to an audio member capable of emitting audio signals associated with events respectively indicated by light emitting members detachably connected to respective said receptor members.

22. The system of claim 21 where at least one of said light emitting members is capable of indicating the existence of one of a plurality of events by changing the light emitted by said light emitting member from a first state to one of a plurality of second states each uniquely associated with one of said plurality of events, said audio member is capable of generating a plurality of audio signals, each said audio signal associated with one of said plurality of events, and said processor is capable of causing said audio member to emit the audio signal associated with a one of said plurality of events when a said receptor member is connected to said light emitting member and said light emitting member changes the light emitted by said light emitting member from said first state to the one of said plurality of second states associated with said one of said plurality of events.

23. The system of claim 22 where at least two of said plurality of events are not mutually exclusive, one of said plurality of events is the concurrence of said at least two of said plurality of events, and said processor is capable of causing said audio member to emit the audio signals associated with said at least two of said plurality of events when said light emitting member changes the light emitted by said light emitting member from said first state to the one of said plurality of second states associated with the one of said plurality of events that is the concurrence of said at least two of said plurality of events.

24. The system of claim 23 where said processor prioritizes said at least two of said plurality of events into a sequence and causes said audio member to emit the audio signals associated with said at least two of said plurality of events in said sequence.

25. The system of claim 22 where at least two of said plurality of events are not mutually exclusive, one of said plurality of events is the concurrence of said at least two of said plurality of events, and said processor prioritizes said at least two of said plurality of events so that said processor causes said audio member to emit the audio signal associated with only one of said at least two of said plurality of events when said light emitting member changes the light emitted by said light emitting member from said first state to the one of said plurality of second states associated with the one of said plurality of events that is the concurrence of said at least two of said plurality of events.

26. The system of claim 22 where at least one of said states is a time varying light signal.

27. The system of claim 26 where said processor is capable of sampling the respective electrical signals received from said receptor member to detect said at least one of said states.

28. The system of claim 21 having a self-contained power source.

29. The system of claim 21 where said receptor members comprise a plurality of charge coupled devices.

30. The system of claim 21 where said receptor members comprise a plurality of CMOS devices.

31. The system of claim 21 where said receptor members are detachably connectable to at least one of a computer, a computer display, a telephone display, a fax machine display, computer printer display, a modem, a PDA, or a network router.

32. The system of claim 21 where said processor is programmable.

33. The system of claim 32 where said audio device is programmable.

34. The system of claim 21 including a headset detachably connectable to said audio device.

35. The system of claim 21 where said audio signal is a voice recording.

36. The system of claim 21 where said processor prioritizes electrical signals from said light sensitive devices into a sequence and processes the electrical signals in said sequence.

37. The system of claim 21 where said processor is capable of recognizing at least one two dimensional pattern of light emitted by said light-emitting member and associating an event with each said at least one pattern.

38. The system of claim 37 where said audio device has a default audio signal associated with undefined patterns of light and said processor causes said audio device to emit said default audio signal when said light emitting device emits an undefined pattern of light.

39. The system of claim 21 where said light-emitting device displays words, said processor is capable of distinguishing said words and causing said audio device to audibly recite said words.

40. A programmable system comprising:

(a) a receptor member having one or more lightreceiving members, each light receiving member capable of generating a respective electrical signal in response to light incident on said light-receiving member, said receptor member detachably connectable to a light-emitting member that indicates the existence of an event by emitting a light signal associated with said event;

(b) a processor operatively connected to said receptor member so as to receive said respective electrical signals from said receptor member, said processor being user-programmable to associate said event with said light signal, said processor operatively connected to a recording audio member capable of emitting an audio signal associated with said event; and (c) said processor being capable of causing said audio member to emit said audio signal when said receptor member is connected to said light emitting member and said light emitting member emits said light signal.

41. The system of claim 40 where said system is programmable by:

(a) activating a programming mode of said system (b) activating a first programming member associated with said processor while causing a light emitting member connected to said receptor member to emit a light signal associated with an event;

(c) deactivating said programming member;

(d) recording an audio signal onto said audio device to be associated with said event; and (e) deactivating said programming mode.

42. A system comprising:

(a) a receptor member having one or more light-receiving members, each light receiving member capable of generating a respective electrical signal in response to light incident on said light-receiving member, said receptor member detachably connectable to a light-emitting member that indicates the existence of an event by emitting a light signal associated with said event;

(b) a processor operatively connected to said receptor member so as to receive said respective electrical signals from said receptor member, said processor operatively connected to an audio member capable of emitting an audio signal associated with said event;

(c) said processor being capable of causing said audio member to emit said audio signal when said receptor member is connected to said light emitting member and said light emitting member emits said light signal; and (d) said receptor member being detachably connectable to at least two of a computer, a computer display, a telephone display, a fax machine display, computer printer display, a modem, a PDA, or a network router.

43. A system comprising:

(a) a receptor member having one or more light-receiving members, each light receiving member capable of generating a respective electrical signal in response to light incident on said light-receiving member, said receptor member detachably connectable to a light-emitting member that indicates the existence of an event by emitting a light signal associated with said event;

(b) a processor operatively connected to said receptor member so as to receive said respective electrical signals from said receptor member, said processor operatively connected to an audio member capable of emitting an audio signal associated with said event;

(c) said processor being capable of causing said audio member to emit said audio signal when said receptor member is connected to said light emitting member and said light emitting member emits said light signal; and (d) where said processor prioritizes electrical signals from said light sensitive devices into a sequence and processes the electrical signals in said sequence.

44. A system comprising:

(a) a receptor member having one or more light-receiving members, each light receiving member capable of generating a respective electrical signal in response to light incident on said light-receiving member, said receptor member detachably connectable to a light-emitting member that indicates the existence of an event by emitting a light signal associated with said event;

(b) a processor operatively connected to said receptor member so as to receive said respective electrical signals from said receptor member, said processor operatively connected to an audio member capable of emitting an audio signal associated with said event; and (c) said processor being capable of causing said audio member to emit said audio signal when said receptor member is connected to said light emitting member and said light emitting member emits said light signal, where said processor is capable of recognizing at least one two dimensional pattern of light emitted by said light-emitting member and associating an event with each said at least one pattern.

45. The system of claim 44 where said audio device has a default audio signal associated with undefined patterns of light and said processor causes said audio device to emit said default audio signal when said light emitting device emits an undefined pattern of light.

* * * * *